US010161249B2

(12) United States Patent
Santarossa

(10) Patent No.: US 10,161,249 B2
(45) Date of Patent: Dec. 25, 2018

(54) SUCTION/COMPRESSION ASSEMBLY FOR A WASTE MATERIAL INTAKE EQUIPMENT OR SYSTEM

(71) Applicant: JUROP S.P.A., Azzano Decimo (IT)

(72) Inventor: Danilo Santarossa, Azzano Decimo (IT)

(73) Assignee: Jurop S.P.a., Azzano Decimo (IT)

( * ) Notice: Subject to any disclaimer, the term of this patent is extended or adjusted under 35 U.S.C. 154(b) by 182 days.

(21) Appl. No.: 15/184,786

(22) Filed: Jun. 16, 2016

(65) Prior Publication Data

US 2016/0369800 A1 Dec. 22, 2016

(30) Foreign Application Priority Data

Jun. 17, 2015 (IT) ..... 102015000024758

(51) Int. Cl.

| | |
|---|---|
| ***F01C 21/00*** | (2006.01) |
| ***F04C 29/00*** | (2006.01) |
| ***F04C 18/08*** | (2006.01) |
| ***F04C 18/12*** | (2006.01) |
| ***F01C 21/10*** | (2006.01) |

(52) U.S. Cl.

CPC ..... *F01C 21/007* (2013.01); *F01C 21/10* (2013.01); *F04C 18/086* (2013.01); *F04C 18/126* (2013.01); *F04C 29/0007* (2013.01); *F04C 2240/30* (2013.01)

(58) Field of Classification Search

CPC ..... F01C 21/007; F04C 29/0007

See application file for complete search history.

(56) References Cited

U.S. PATENT DOCUMENTS

| | | | | |
|---|---|---|---|---|
| 5,090,879 | A | 2/1992 | Weinbrecht | |
| 5,356,275 | A * | 10/1994 | Brenner | F04C 29/0092 137/597 |
| 2016/0369804 | A1 * | 12/2016 | Santarossa | F01C 21/10 |

FOREIGN PATENT DOCUMENTS

| | | |
|---|---|---|
| EP | 1150015 | 10/2001 |

OTHER PUBLICATIONS

Italian Search Report and Written Opinion for Italian Patent Application Serial No. 102015000024758; dated Apr. 5, 2016.

* cited by examiner

*Primary Examiner* — Mary A Davis

(74) *Attorney, Agent, or Firm* — Stetina Brunda Garred & Brucker

(57) ABSTRACT

The invention relates to a suction/compression assembly for aspirating/compressing gases from/in a system to/from an external environment. The assembly includes an operating machine comprising a body, which defines a chamber, within which one or more rotors are housed, rotating about a corresponding rotation axis. Such a chamber has a symmetrical transverse section evaluated on a plane with respect to at least one first reference plane on which said rotation axis lies. The assembly comprises a device for injecting gas into said chamber which comprises a manifold, connectable to an external source, and a plurality of injection pipes connected to the manifold and to the body of the machine. The body defines a plurality of injection passages, each of which is configured to make one of said injection pipes communicating with the chamber of the machine.

8 Claims, 5 Drawing Sheets

SUCTION/COMPRESSION ASSEMBLY FOR A WASTE MATERIAL INTAKE EQUIPMENT OR SYSTEM

CROSS-REFERENCE TO RELATED APPLICATIONS

The present application claims priority to Italian Patent Application No. 102015000024758 filed Jun. 17, 2015, the entirety of the disclosures of which are expressly incorporated herein by reference.

STATEMENT RE: FEDERALLY SPONSORED RESEARCH/DEVELOPMENT

Not Applicable

FIELD OF THE INVENTION

The present invention relates to the manufacture of equipment and/or systems for aspirating waste material in liquid, solid, powder or muddy form, etc. In particular, the invention relates to a suction/compression assembly installable preferably, but not exclusively, on a movable collection equipment, such as a tank vehicle.

BACKGROUND ART

Within the scope of the manufacture of equipment for cleaning and/or for waste collection and treatment, it is known to use suction/compression assemblies configured to generate the vacuum in a collection system, which may be for example a tank mounted on a vehicle, and/or to compress air into the system itself. More precisely, the expression "suction/compression assembly" means the combination formed by an operating machine and by the components required to connect the same to any system with the purpose of aspirating or compressing gas from/into the tank while preventing leakage/loss of the gas itself.

The operating machines normally used in such assemblies are of the volumetric type, that is, configured to transfer a mass of gas from an intake section to an exhaust section of a chamber. To this end, in most cases, lobe rotors are positioned within the chamber through which the transfer of the gas mass between the indicated sections is carried out.

It is also known that a suction/compression assembly may be used to carry out work under pressure or vacuum working. In the first case, the operating machine compresses the air from the intake section, at substantially atmospheric pressure, to the exhaust section with a variation normally of the order of 1 bar. Also in the case of vacuum working, the machine compresses the air from the intake section to the exhaust section, but the latter is at atmospheric pressure. The maximum depression usually reaches 50 mbar. In order to allow varying the operation of the machine, the intake assembly comprises a four-way valve which is adjusted in at least two operative positions. In the first operative position, corresponding to vacuum working, the intake section of the chamber is made communicating with the system and the exhaust section is made communicating with the external environment. In the second position, corresponding to work under pressure, the intake section is made communicating with the external environment and the exhaust section with the system.

During the normal operation of a suction/compression assembly, the gas at the exhaust section has a higher temperature than the intake section. Irreversibility and volumetric losses increase the real value of the exhaust temperature compared to an ideal value calculated by assuming that the passage of the gas in the chamber takes place according to a reversible adiabatic transformation. In order to limit/lower the compression end temperature, gas is introduced inside the chamber to prevent the compression from being carried out by the exhaust gas at the exhaust temperatures, but by the injection gas substantially at ambient pressure and temperature (lower than that of exhaust).

In any case, it has been seen that in currently known suction/compression assemblies, the technical solutions adopted for the direct injection of gas into the chamber are not satisfactory, especially in terms of encumbrance. Mutually independent pipes are normally used for gas injection, which have complicated shapes and determined in part by the structure of the components of the operating machine. In this regard, a particularly critical component of the operating machine is represented by the elements which allow the connection of the machine to the equipment for which the machine is intended. It has been seen that the number, the arrangement and the configuration of the connecting elements greatly affects the configuration, the position, the number of injection pipes that can be installed and, ultimately, the cooling efficiency.

Moreover, the definition of the injection pipes must also take account of the available space on the equipment for which suction/compression assembly is intended. In this sense, the injection pipes currently used are little versatile and actually usable for only one installation configuration of the assembly.

In view of the above, the main task of the present invention is to provide an suction/compression assembly which allows overcoming the limits of the prior art described above. Within this task, a first object of the present invention is to provide a particularly compact suction/compression assembly. Last but not least, an object of the present invention is to provide a suction/compression assembly that is compact, reliable and easy to be implemented in a cost-effective manner.

SUMMARY OF THE INVENTION

The object of the present invention is a suction/compression assembly for aspirating/compressing a first gas from/into a system. Such an assembly includes an operating machine which comprises a body defining a chamber inside which one or more rotors are housed, configured to transfer a first gas from an intake section to an exhaust section. Each rotor rotates about a corresponding rotation axis. The assembly comprises an injection device of a second gas into the chamber. Such a device comprises a manifold, connectable to a source of said second gas, preferably at ambient pressure. A plurality of injection pipes is connected to the main collector and to the machine body. Such a body defines a plurality of injection passages, each of which is configured to make one of the injection pipes communicating with the chamber of the machine. Preferably, the machine comprises a plurality of elements for the connection to an equipment, such elements define a support surface for the operating machine. At least two of said connecting elements are connected to a first part of the body and at least one further element is connected to a second part of the body opposite to the first part with respect to said first reference plane. Said further element is connected to the second part of the body in an intermediate position between two injection passages. It has been seen that this solution allows installing the injection device in a position adjacent to the body of the operating machine while ensuring a stable connection of the body itself to an equipment.

BRIEF DESCRIPTION OF THE DRAWINGS

Further features and advantages of the present invention will become more apparent from the following detailed description, given by way of a non-limiting example and shown in the accompanying drawings, in which.

DETAILED DESCRIPTION

Figure 1:
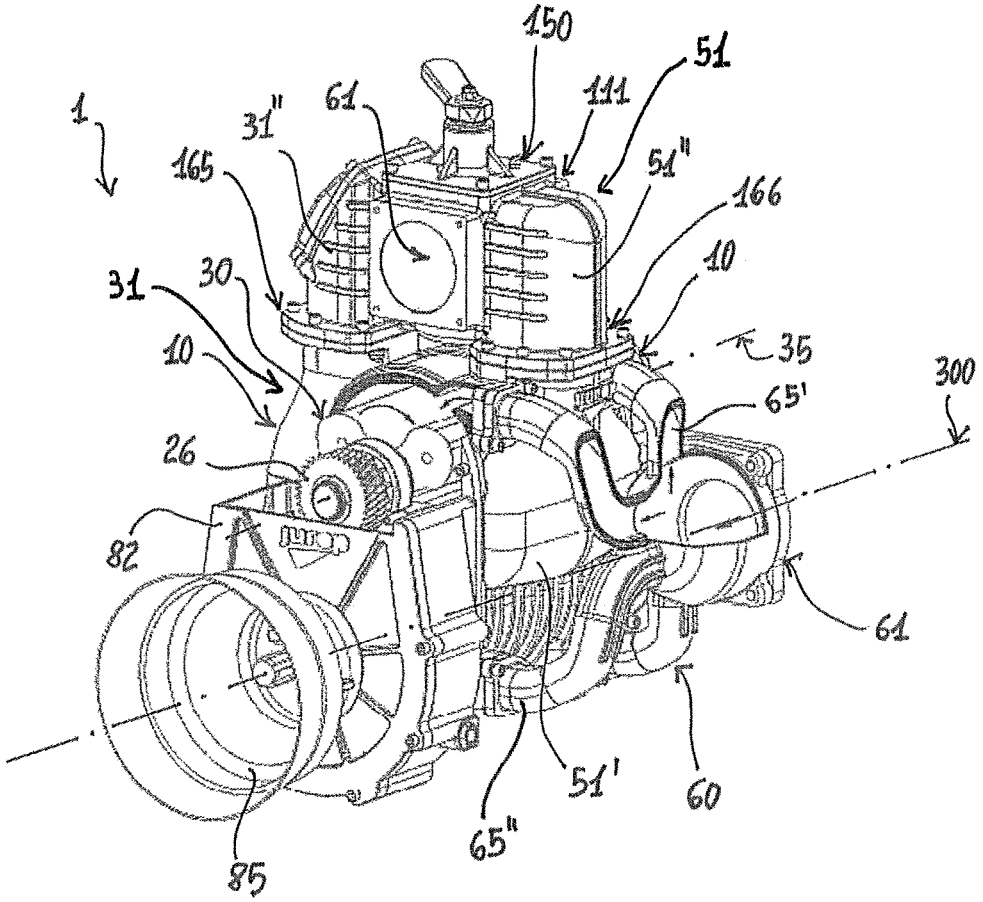
FIG. 1 is a partially sectional perspective view of a possible embodiment of an intake assembly comprising an operating machine according to the present invention.

FIG. 1 is a partially sectional perspective view of an assembly 1 comprising an operating machine 10 according to the present invention. In particular, assembly 1 can be used to aspirate gases (such as air) from a system, or alternatively to introduce air under pressure (compressed) within the system itself.

Machine 10 comprises a body 11 defining a chamber 15 inside which operative means are housed to transfer gas from an intake section 15' to an exhaust section 15" of the chamber itself. The operative means comprise one or more rotors 30. Each rotor 30 rotates about a corresponding rotation axis 35. In the embodiment shown in the figures, for example, machine 10 comprises two rotors 30, each of which has lobes 33 according to a per se known configuration.

Figure 5:
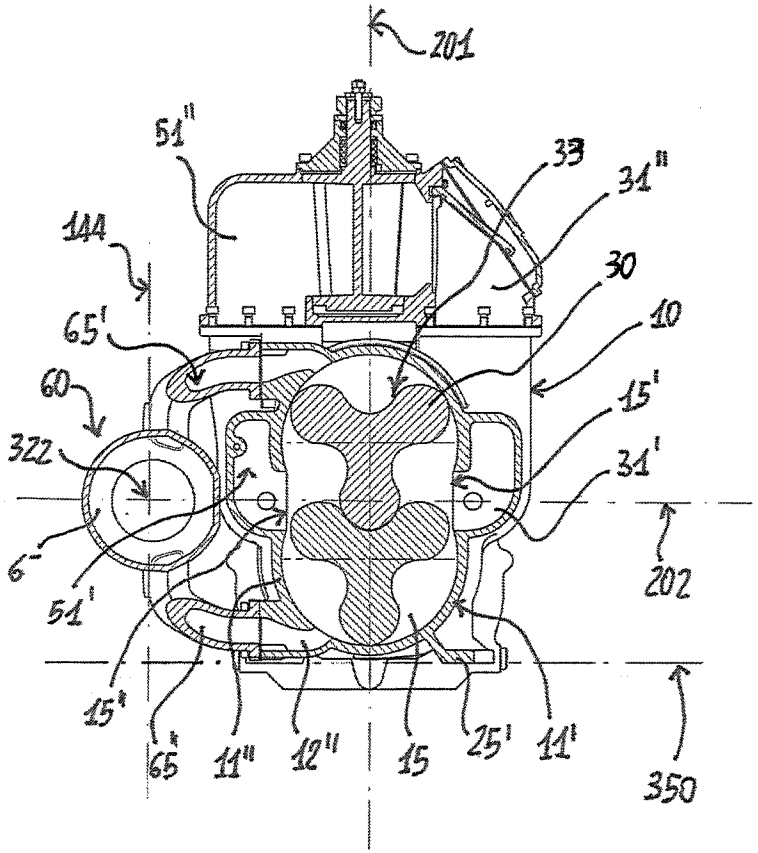
FIG. 5 is a view according to the section plane V-V in FIG. 4.
Figure 4:
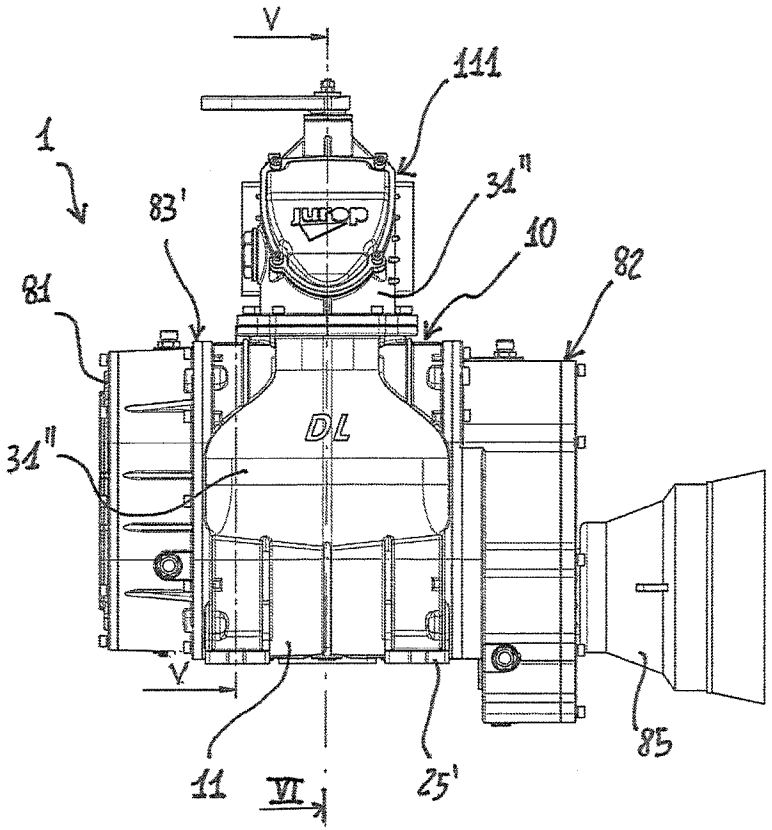
FIG. 4 is a side view of the assembly in FIG. 1.
Figure 6:
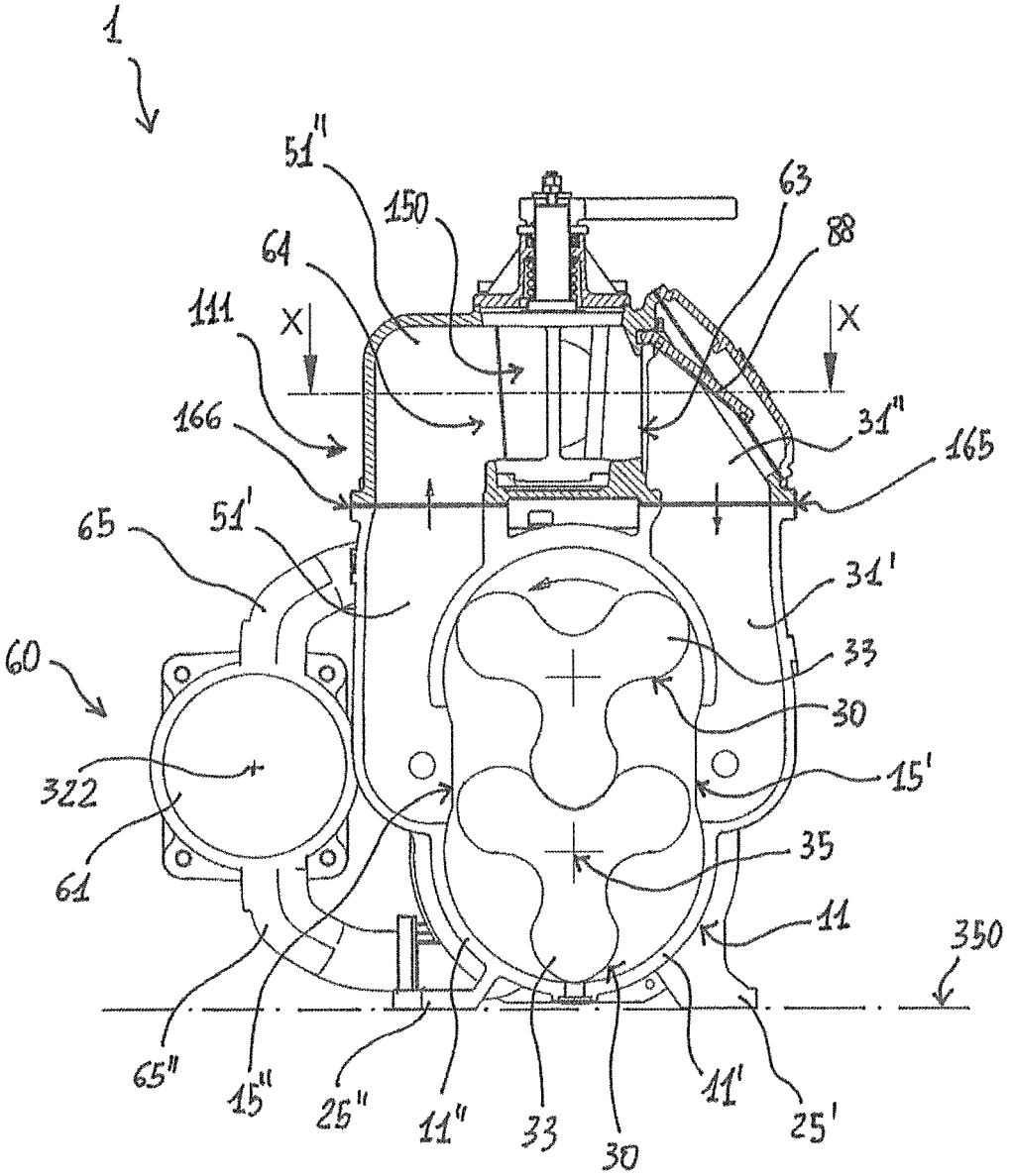
FIG. 6 is a view according to the section plane V-VI in FIG. 4.

With reference to FIGS. 5 and 6, chamber 15 extends along an extension direction 300 parallel to the rotation axis 35 of rotors 30. Chamber 15 is also configured in such a way as to have a transverse section symmetrical with respect to a least one first reference plane 201 of the section itself on which the rotation axis 35 of said at least one rotor 30 lies. Such a transverse section is instead evaluated on a section plane substantially orthogonal to the first plane 201. For the purposes of the present invention, the term "chamber 15" therefore indicates the space within which rotors 30 rotate.

Figure 2:
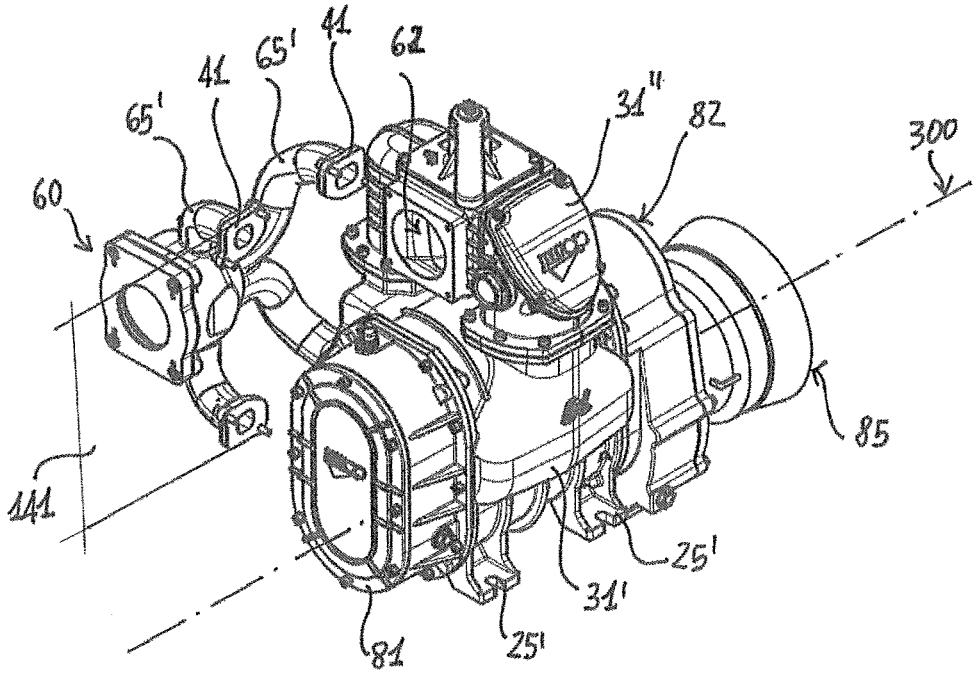
FIGS. 2 and 3 are partially exploded views of the assembly in FIG. 1.
Figure 3:
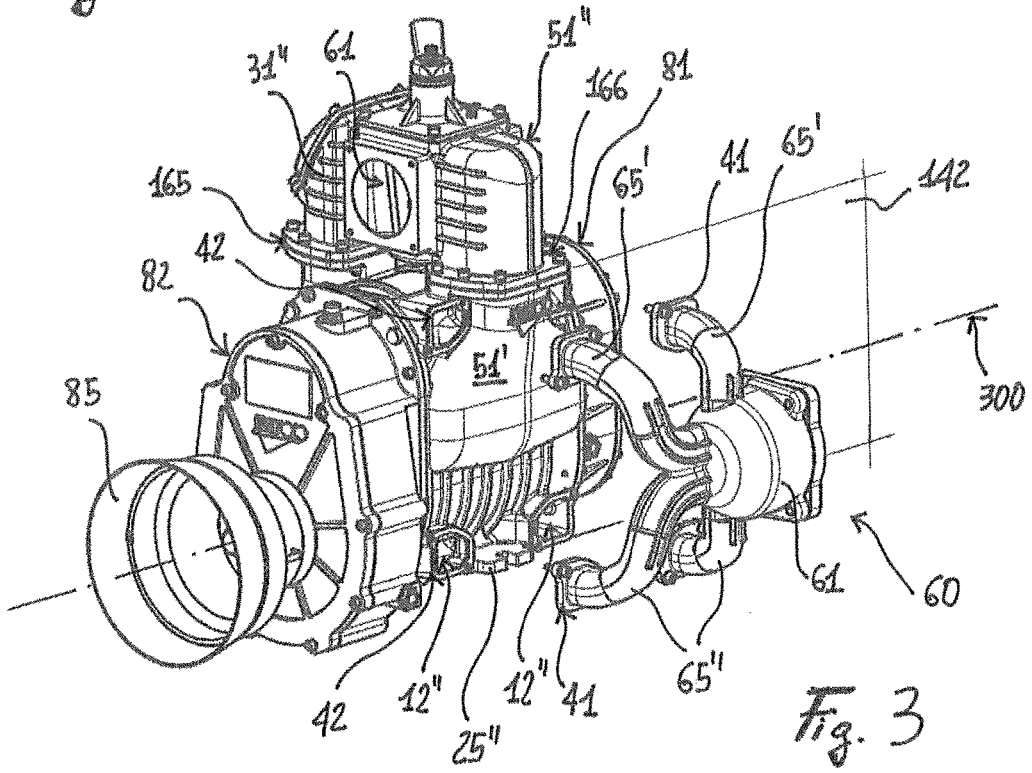

With reference to FIGS. 2 to 3, according to a per se known solution, machine 10 further comprises a first head 81 and a second head 82 connected to opposite sides of body 11 to close chamber 15 along the extension direction 300. Still according to a solution known per se, the two heads 81, 82 are configured to internally house support means for the ends 26 of rotors 30 mentioned above and/or transmission means configured to rotate the rotors themselves. In this regard, in the example shown, the transmission means (not shown) housed in the second head 82 are connectable to an external motor through a mechanical transmission 85, such as Cardan. Each of the two heads 81, 82 is connected to body 1 that defines chamber 15 through a corresponding flange connection 83', 83".

In the embodiment shown in the Figures, body 11 is defined in one body with a first portion 31' of a intake pipe 31 communicating with the intake section 15' and with a first portion 51' of an exhaust pipe 51 communicating with the exhaust section 15". Assembly 1 comprises a further body 111 which defines, in one piece, a second portion 31" of the intake pipe and a second portion 51" of the exhaust pipe 51. The two bodies 11, 111, are connected through a first flange joint 165 connecting the-two portions 31', 31" of the intake-pipe 31 and a second flange joint 166 which, connects the two portions 51', 51" of the exhaust pipe 51 to each other.

Still in the embodiment shown in the Figures, assembly 1 also comprises a four-way valve 150 housed within body 111. Such a valve has a per se known shape and comprises a first opening 61 connectable to a system (not shown), a second opening 62 connectable to the external environment, a third opening 63 in communication with the intake pipe 31 and a fourth opening 64 in communication with the exhaust pipe 51. Assembly 1 shown in the figures preferably also comprises a "clapper valve" 88 placed in the intake pipe 31.

According to the invention, machine 10 comprises a device 60 for injecting a second gas (hereinafter referred to as injection gas) into chamber 15. The injection gas may be or not be of the same nature as that processed by rotors 30 into chamber 15. Device 60 comprises a manifold 61 intended to be connected to an injection gas source, preferably at ambient pressure. Device 60 also comprises a plurality of injection pipes 65', 65" connected to manifold 61 and to body 11 of machine 10. Body 11 of the machine further defines a plurality of injection passages 12', 12", each of which is configured to make one of pipes 65', 65" communicating with chamber 15. With reference to FIG. 1, the gas in input into manifold 61 is distributed into the various pipes 65', 65" to flow into passages 12', 12" defined by body 11 up to inside chamber 15 in the space comprised between two lobes 33 of rotor 30. Preferably, manifold 61 and the injection pipes 65', 65" are made in one piece. Preferably, manifold 61 has a hollow cylindrical structure which develops about an axis 322.

According to the invention, machine 10 comprises a plurality of connecting elements 25', 25" configured to secure the machine itself to an equipment, which may be, for example, a vehicle for the collection/treatment of liquid waste or in muddy form. Such connecting elements 25', 25" define a support surface 350 for the machine. At least two first connecting elements 25' are connected to a first part 11' of body 11 and at least one further connecting element 25" is connected to a second part 11" of body 11 opposite to said first part 11' with respect to the first reference plane 201. In particular, according to the invention, said further element 25" is connected to the second part 11' in an intermediate position between two injection passages. It has been seen that the particular arrangement of the connecting elements 25', 25" with respect to the injection passages 12', 12" advantageously allows minimizing the overall dimensions since the injection device 60 is placed in a position immediately adjacent to body 11.

With reference again to FIGS. 2 and 3, according to a preferred embodiment, the injection passages 12', 12" are all defined through said second part 11" that is the same part of body 11 to which said further element 25" defined above is connected. Consequently, all pipes 65', 65" of the injection device 60 are connected to said second part 11", as clearly visible in FIGS. 2, 3 and 5.

Still according to a preferred embodiment, body 11 defines first injection passages 12' in a position above a second reference plane 202 which is orthogonal to the first reference plane 201 mentioned above (see FIG. 5) and preferably parallel to said support surface 350. Such a second plane 202 is preferably also a symmetry plane of chamber 15. Preferably, body 11 also defines second injection passages 12" in a position below the second reference plane 202. Said first passages 12' are also preferably defined in a position specular to the second passages 12" with respect to such a second symmetry plane 202. In the case of a machine 10 with two rotors 30, as shown in the figure, the arrangement of passages 12', 12" described above allows the injection gas to mix with that processed by the two rotors 30.

It is noted that the connecting element 25" connected to the second part 11" of body 11 is defined in a position interposed between two second passages 12" defined in a position below the second plane 202. In particular, it is noted that said connecting element 25" emerges from body 11 between two portions of the same, each of which defines one of said second passages 12".

In view of the arrangement of passages 12', 12" just described above, the plurality of pipes 65', 65" of the injection device 60 comprise first pipes 65' and second pipes 65". Each of the first pipes 65' is connected to one of the first passages 12' and each of the second pipes 65" is connected to one of the second passages 12".

According to a preferred embodiment, the number of first passages 12' and second passages 12" is two. In particular, the first passages 12' are specular with respect to a third reference plane 103 (shown in FIG. 7) substantially orthogonal to said first plane 201 and to said second plane 202. Each of said first passages 12' is further defined in a position proximal to one of heads 81, 82 of machine 10. Likewise, the second passages 12" are specular with respect to said third plane 103, and each of them is defined in a position proximal to one of heads 81, 82 of said machine 10.

Figure 7:
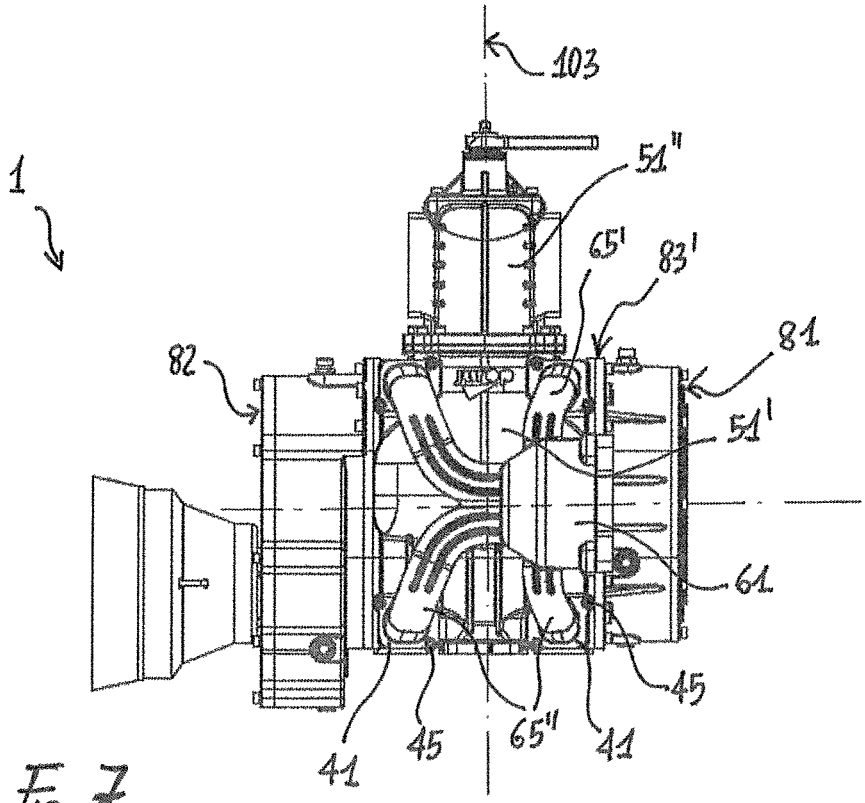
FIGS. 7 and 8 are two side views of the assembly in FIG. 1, each relating to a possible installation configuration.
Figure 8:
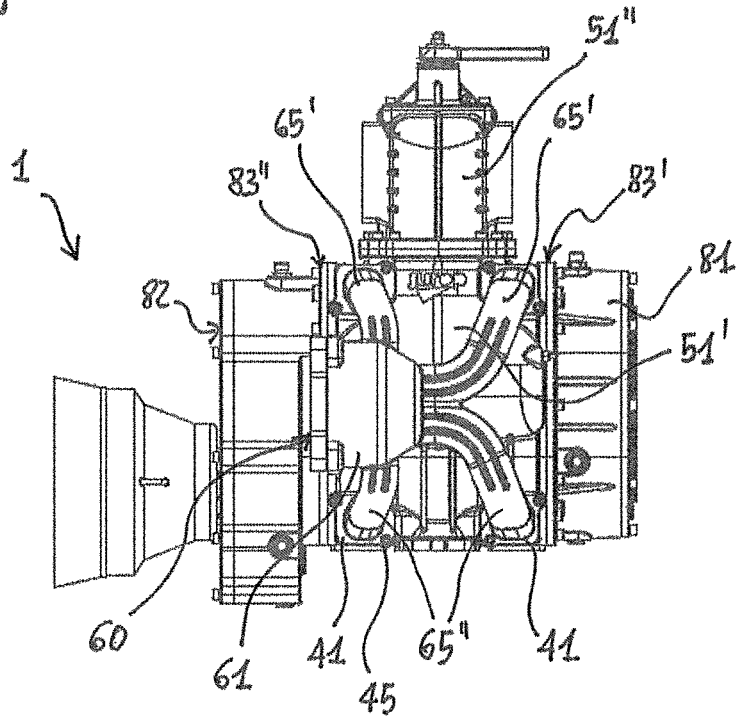

With reference to FIGS. 7 and 8, pipes 65', 65" of the injection system 60 are connectable to body 11 of machine 10 according to at least a first installation mode and a second installation mode that determine a first operative position and a second operative position, respectively, for manifold 61.

To this end, each injection pipe 65', 65" is connected to body 11 of machine 10 through a flange connection 40 defined by a flat flange end 41 of pipe 65', 65" and a flat portion 42 defined by the second part 11" of body 11. Such a flat portion 42 also defines the inlet of a corresponding injection passage 12', 12". The flange connection 40 is completed by screw connection means 45 or other functionally equivalent means which stably lock the flat end 41 against the flat portion 42 defined above. Pipes 65', 65" are configured in such a way that the flat ends 41 define a first connection plane 141 (shown in FIG. 2). In other words, the flat ends 41 of pipes 65', 65" are coplanar on such a first connection plane 141. Likewise, also the flat portions 42 of body 11 define a second connection plane 142 (shown in FIG. 3).

The coplanarity of the flat ends 41 and of the flat portions 42 on one hand, and the arrangement of the first pipes 65' (specular to the second pipes 65" with respect to the second plane 202) on the other hand allow having the dual installation mode of pipes 65', 65" to body 11 described above. From a comparison between FIGS. 7 and 8, it is seen that in the configuration in FIG. 7 the inlet of manifold 61 is facing towards the first head 81 of the operating machine, while in the configuration in FIG. 8, manifold 61 is rotated by 180°, that is, towards the second head 82.

According to another aspect, the first pipes 65' also preferably have a configuration/shape specular to the second pipes 65" with respect to a reference plane 205 parallel to the second plane 202 and containing the central axis 322 of manifold 61. The term "configuration" is meant to indicate substantially the profile with which such pipes 65', 65" develop from the outlet of manifold 61 to the corresponding flat end 41 defined above. It is noted that such a specular configuration allows having manifold 61 at a same height irrespective of the installation mode.

According to a further aspect, it is noted that pipes 65', 65" have such a shape that the first connection plane 141, indicated above, is defined in a position spaced apart from a further reference plane 144 parallel and containing the manifold axis. With reference to FIG. 5, it is seen that the distance between the first connection plane 141 and the reference plane 144 is established so as to minimize the encumbrance, i.e. so that manifold 61 is operatively arranged in a position substantially adjacent to body 11.

The solutions adopted for the suction/compression assembly according to the invention allow fully achieving the intended task and objects. In particular, the assembly is particularly compact and reliable and implemented through a reduced number of components. The positioning of the one-way valve inside the intake pipe and in a position adjacent to the seat of the four-way valve allows a reliable operation of the suction/compression assembly in any operating conditions of the system.

The invention claimed is:

1. A suction/compression assembly for aspirating/compressing a first gas from/in a system, said suction/compression assembly including:

an operating machine comprising a body, which defines a chamber, within which one or more rotors are housed, each rotating about a corresponding rotation axis;

wherein said suction/compression assembly comprises an injection device for injecting a second gas into said chamber, said injection device comprising a main manifold, connectable to a source of said second gas, and a plurality of injection pipes connected to said main manifold and to said body of said operating machine;

wherein said body defines a plurality of injection passages each of which is configured to make each of said injection pipes communicating with said chamber of said operating machine;

wherein said operating machine comprises a plurality of connecting elements configured to connect said operating machine to equipment, said connecting elements defining a support surface for said operating machine, wherein at least one of said two connecting elements are connected to a first part of the body and wherein at least one further connecting element is connected to a second part of the body opposite to said first part with respect to a first reference plane which is substantially orthogonal to said support surface and on which said rotation axis lays, said further connecting element being connected to said second part in a position interposed between two injection passages of the plurality of injection passages;

wherein said plurality of injection passages comprises first passages defined in a position above a second reference plane which is substantially orthogonal to said first reference plane and second passages defined in a position underneath said second plane, said further connecting element being connected to said second part in a position interposed between two of said second passages, said plurality of injection pipes comprising first pies, each of which communicating with one of said first passages, and second nines, each of which communicating with one of said second passages; and wherein said first passages are two in number and specular with respect to a third reference plane which is substantially orthogonal to said first plane and to said second plane; said second passages are two in number and specular with respect to said third reference plane.

2. The suction/compression assembly according to claim 1, wherein said connecting elements are made in one piece with said body of said operating machine.

3. The suction/compression assembly according to claim 1, wherein each of said pipes is connected to said body of said operating machine by means of a flange connection defined by a first flat flange end of a pipe and by a flat flange portion defined by the body, said flat flange portion defining the inlet of a corresponding passage of said passages, said flange connection comprising connection means which connect said first flat flange end to said flat flange portion.

4. The suction/compression assembly according to claim 3, wherein said first flat flange ends of the plurality of injection pipes define a first connection plane and wherein said flat flange portions define a second connection plane, said first connection plane and said second connection plane coinciding upon the connection of said pipes to said body.

5. The suction/compression assembly according to claim 1, wherein said plurality of pipes of an injection system are connectable to said body in multiple positions comprising: a first operative position for said main manifold or a second operative position for said main manifold.

6. The suction/compression assembly according to claim 1, where said injection pipes and said main manifold are made in one piece.

7. The suction/compression assembly according to claim 1, wherein the shape of said first pipes is specular to said second pipes with respect to a reference plane parallel to said second plane and containing an axis around which said main manifold develops.

8. Equipment for collecting or processing waste, or both, comprising a suction/compression assembly according to claim 1.

* * * * *